US006198059B1

(12) United States Patent
Jou

(10) Patent No.: US 6,198,059 B1
(45) Date of Patent: Mar. 6, 2001

(54) TILT SWITCH

(76) Inventor: Tien-Ming Jou, No. 41, San-Hsi-Wu St., Pei Dist., Taichung City (TW)

( * ) Notice: Subject to any disclaimer, the term of this patent is extended or adjusted under 35 U.S.C. 154(b) by 0 days.

(21) Appl. No.: 09/590,258

(22) Filed: Jun. 9, 2000

(51) Int. Cl.[7] ..... H01H 35/02
(52) U.S. Cl. ..... 200/61.52
(58) Field of Search ..... 200/61.45 R–61.45 M

(56) References Cited

U.S. PATENT DOCUMENTS

| | | | | |
|---|---|---|---|---|
| 3,108,252 | * | 10/1963 | Torres | 340/71 |
| 4,751,353 | * | 6/1988 | Stephens | 200/277 |
| 5,136,126 | * | 8/1992 | Blair | 200/61.52 |
| 5,155,308 | * | 10/1992 | Blair | 200/61.52 |
| 5,602,429 | * | 2/1997 | Scgiebelhuth | 307/121 |

* cited by examiner

*Primary Examiner*—Michael Friedhofer
(74) *Attorney, Agent, or Firm*—Sughrue, Mion, Zinn, Macpeak & Seas, PLLC

(57) ABSTRACT

A tilt switch includes an insulating housing with two first insert holes proximate to a bottom wall and aligned with each other and defining a first distance, and a second insert hole proximate to a top wall. Two first and one second electric contact members include first and second insert end portions press fitted within the first and second insert holes and extending into the housing, and first and second electric contact terminals extending outwardly of the housing. The second insert end portion is spaced apart from the first insert end portions with a second distance. An electrically conductive ball member is disposed in the housing, has a diameter larger than both the first and second distances so as to engage the first insert end portions, and is movable on a rolling guideway between a first position where the ball member engages the second insert end portion when the rolling guideway is in a horizontal position so as to establish electrical connection among the first and second electric contact terminals, and a second position where the ball member disengages the second insert end portion when the rolling guideway is tilted from the horizontal position so as to break the electrical connection among the first and second electric contact terminals.

6 Claims, 7 Drawing Sheets

TILT SWITCH

BACKGROUND OF THE INVENTION

1. Field of the Invention

This invention relates to a tilt switch, more particularly to a tilt switch including an electrically conductive ball member received in an insulating housing to engage first insert end portions of two first electric contact members therein, and movable to engage or disengage a second insert end portion of at least one second electric contact member to establish or break electrical connection among first and second electric contact terminals of the first and second electric contact members.

2. Description of the Related Art

Referring to FIGS. 1 and 2, a conventional tilt switch 10 is shown to include an electrically conductive housing 11 with an opening 111, two conductive ball members 12 which are received in the housing 11 via the opening 111, an insulating cover 14 which covers the opening 111 and which has a through hole 141 such that a first electric contact member 13 is press fitted within the through hole 141 and an enlarged head portion 131 thereof abuts against the cover 14, and a second electric contact member 15 which is clamped between the cover 14 and the housing 11 by deforming the housing 11 radially and inwardly. When the housing 11 is in an upright position, the ball members 12 engage the first electric contact member 13 by virtue of gravity and an inner peripheral wall of the housing 11, thereby establishing electrical connection between the first and second electric contact members 13, 15. Once the housing 11 is vibrated, the ball members 12 are moved to disengage the head portion 131 of the first electric contact member 13, thereby breaking the electrical connection. However, the second electric contact member 15 is liable to be stripped from the housing 11 due to the vibration of the latter. In addition, as shown in FIG. 3, when the ball members 12 are registered with each other vertically and disengage the inner peripheral wall of the housing 11, undesired breaking of the electrical connection will occur.

SUMMARY OF THE INVENTION

The object of the present invention is to provide a tilt switch which can ensure electrical connection and in which electric contact members are secured firmly on a housing.

According to this invention, the tilt switch includes an insulating housing which has top, bottom, right, left, front and rear walls that cooperate to confine an accommodating space. The left wall has an inner wall surface and an outer wall surface which is disposed opposite to the inner wall surface, and further has two first insert holes disposed proximate to the bottom wall and at least one second insert hole disposed proximate to the top wall. The first insert holes are aligned with and are spaced apart from each other in a first transverse direction, and define a first distance therebetween in the first transverse direction. A pair of elongate first electric contact members includes first insert end portions of such a dimension so as to be press fitted within the first insert holes and extending in a second transverse direction into the accommodating space towards the right wall. The first insert end portions of the first electric contact members are parallel to each other and are spaced apart from each other in the first transverse direction with the first distance so as to define a rolling guideway therebetween. Each first electric contact member further includes a first electric contact terminal which extends outwardly of the left wall and which is bent downwardly to extend beyond the bottom wall. At least one elongate second electric contact member includes a second insert end portion of such a dimension so as to be press fitted within the second insert hole and extending in the second transverse direction into the accommodating space such that the second insert end portion is spaced apart from the first insert end portions with a second distance in a longitudinal direction and is shorter than the first insert end portions in the second transverse direction, and a second electric contact terminal which extends outwardly of the left wall, and which is bent downwardly to extend beyond the bottom wall. An electrically conductive ball member is disposed in the accommodating space, and has a diameter larger than both the first and second distances such that the ball member engages the first insert end portions and is movable on and is guided by the rolling guideway between a first position where the ball member engages the second insert end portion when the rolling guideway is in a horizontal position so as to establish electrical connection among the first and second electric contact terminals, and a second position where the ball member is proximate to the right wall to disengage the second insert end portion when the rolling guideway is tilted from the horizontal position so as to break the electrical connection among the first and second electric contact terminals.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
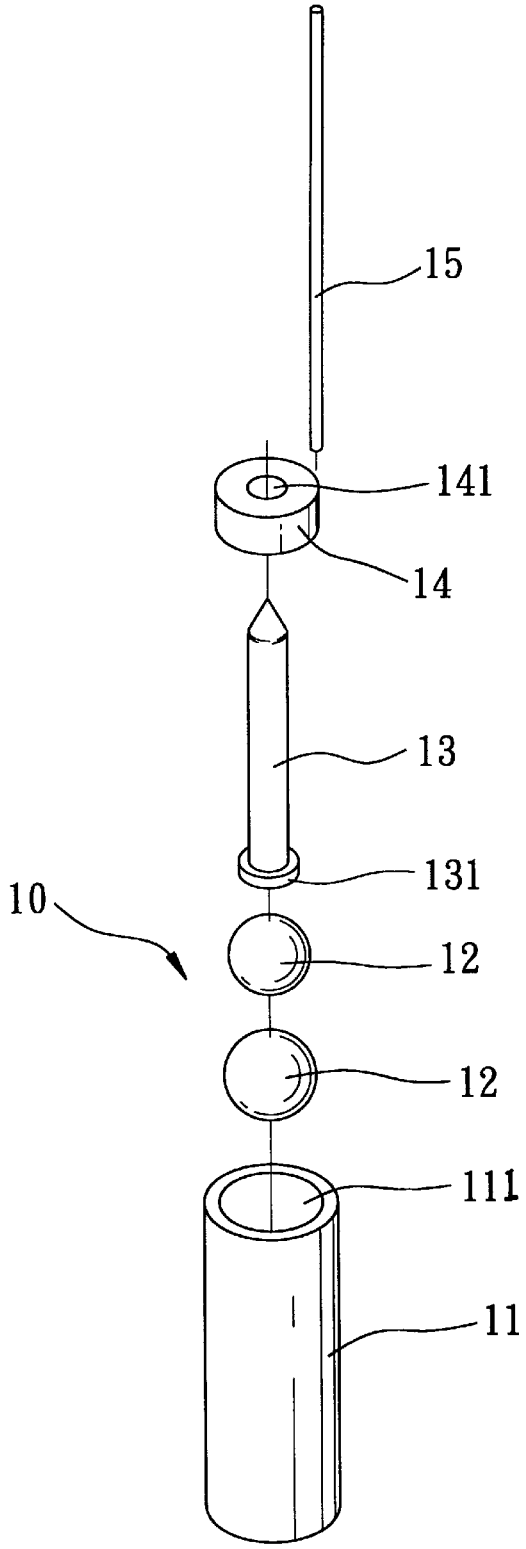
FIG. 1 PRIOR ART
FIG. 1 is an exploded view of a conventional tilt switch.
Figure 2:
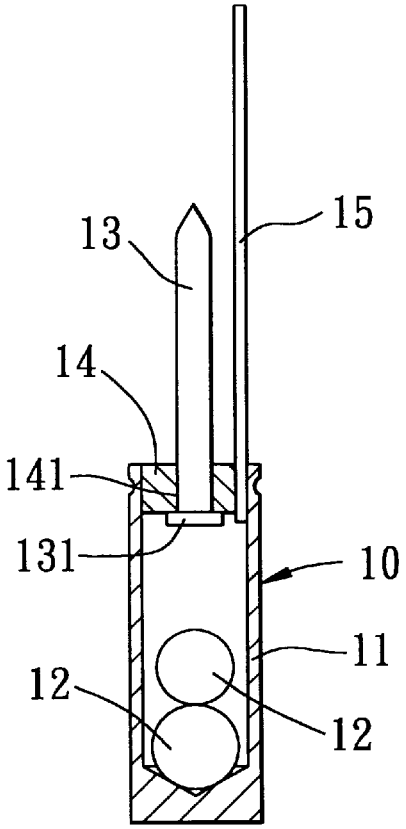
FIG. 2 PRIOR ART
FIG. 2 is a sectional view of the conventional tilt switch.
Figure 3:
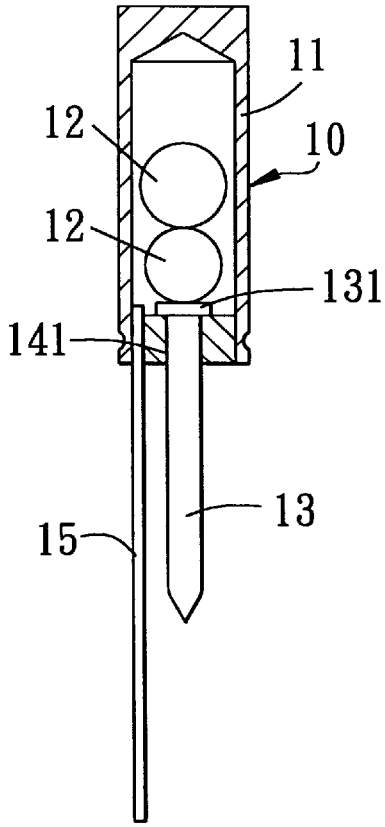
FIG. 3 PRIOR ART
FIG. 3 is a sectional view of the conventional tilt switch when in a cut-off state.
Figure 4:
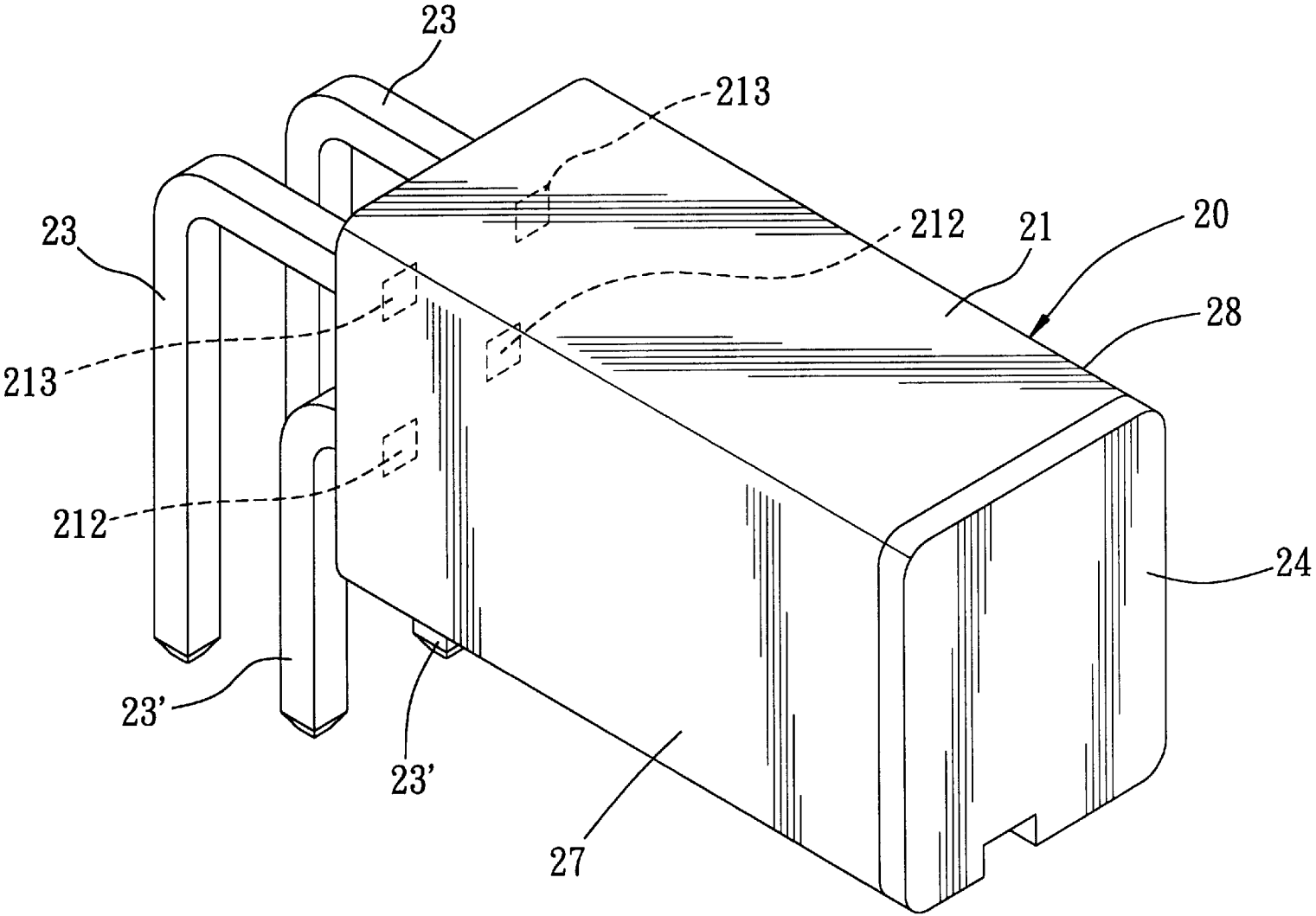
FIG. 4 is a perspective view of a preferred embodiment of a tilt switch according to this invention.
Figure 5:
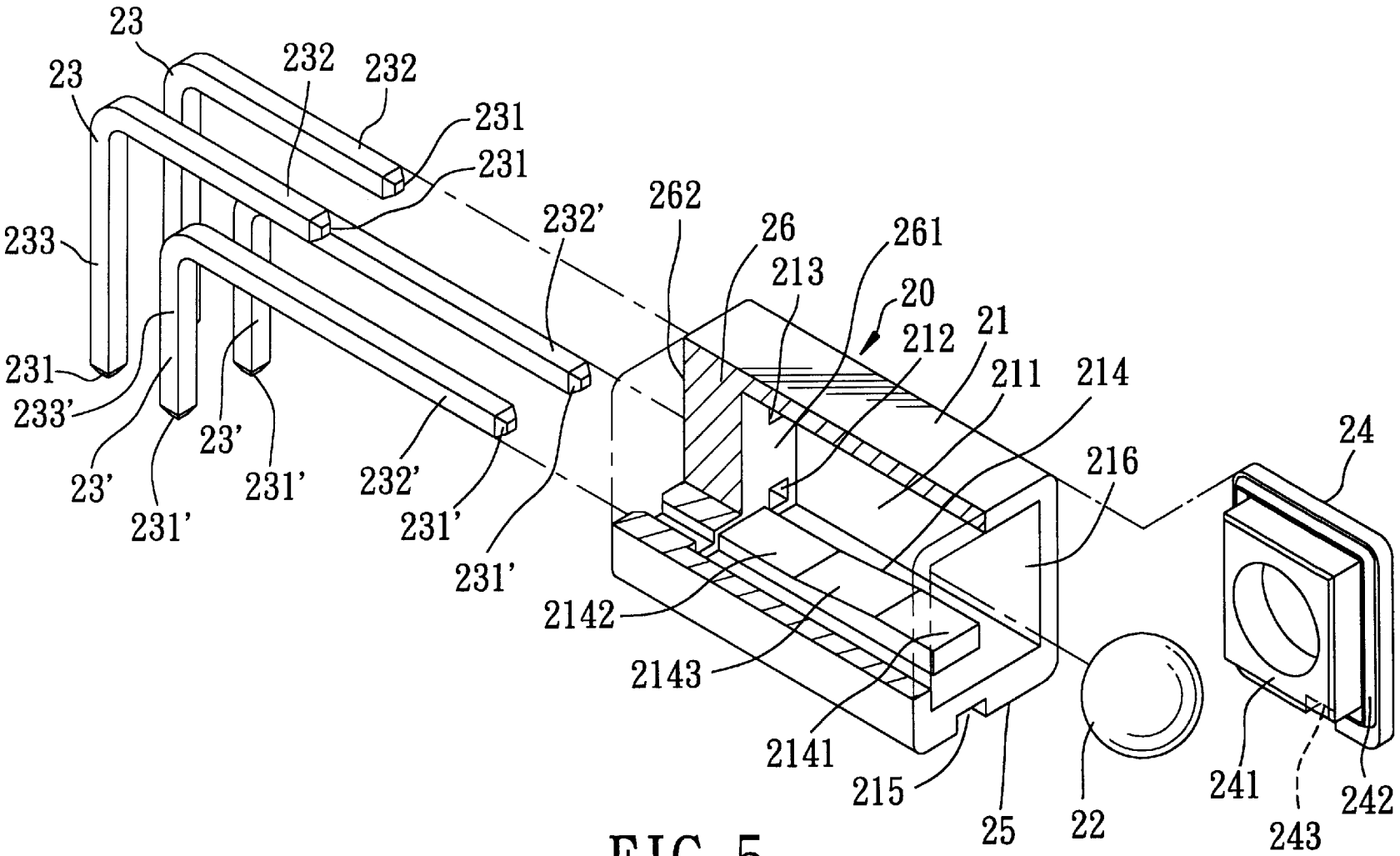
FIG. 5 is an exploded perspective view of the preferred embodiment.

Referring to FIGS. 4 and 5, the preferred embodiment of the tilt switch according to the present invention is shown to comprise an insulating housing 20, a pair of elongate first electric contact members 23', a pair of elongate second electric contact members 23, and an electrically conductive ball member 22.

Figure 6:
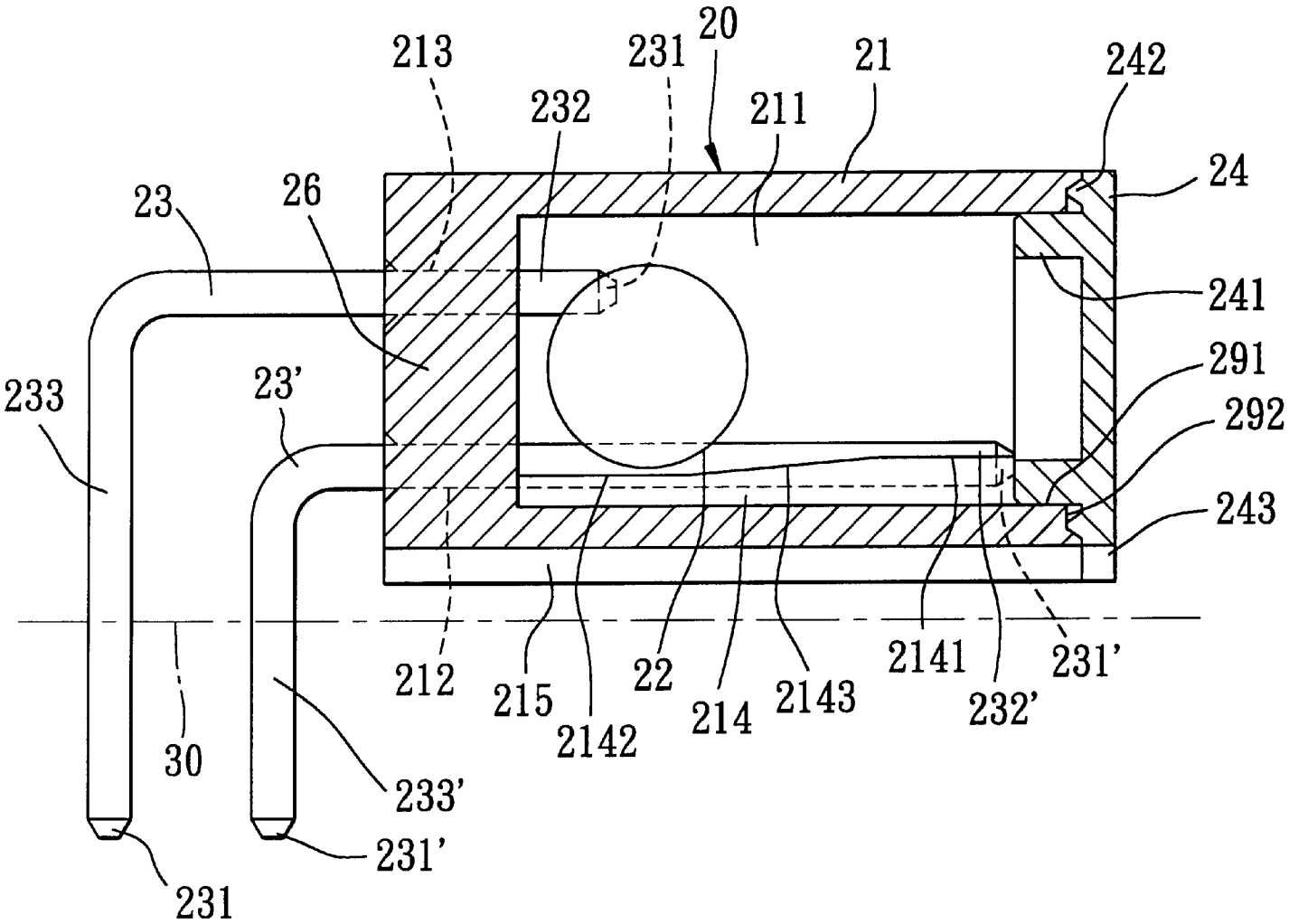
FIG. 6 is a longitudinal sectional view of the preferred embodiment.

The housing 20 includes top and bottom walls 21,25 which are spaced apart from each other in a longitudinal direction when the tilt switch is in an upright position, front and rear walls 27,28 which are spaced apart from each other in a first transverse direction transverse to the longitudinal direction and which extend from the top wall 21 to the bottomwall 25 in the longitudinal direction, and right and left walls 24, 26 which are spaced apart from each other in a second transverse direction transverse to both the longitudinal and first transverse directions and which extend from the top wall 21 to the bottom wall 25 in the longitudinal direction so as to cooperate with the front, rear, top and bottom walls 27,28,21,25 to confine an accommodating space 211. The left wall 26 has an inner wall surface 261 and an outer wall surface 262 which is disposed opposite to the inner wall surface 261 in the second transverse direction and which has two first insert holes 212 and two second insert holes 213 that are disposed respectively proximate to the bottom and top walls 25,21. Each of the first and second insert holes 212,213 extends in the second transverse direction to communicate with the inner wall surface 261. The first insert holes 212 are aligned with and are spaced apart from each other in the first transverse direction so as to define a first distance therebetween in the first transverse direction. With reference to FIG. 6, the top, bottom, front and rear walls 21,25,26,28 respectively have right inner peripheral portions 291 which are connected to one another to confine an opening 216. The right wall 24 is provided with a plug portion 241 of such a dimension so as to be press fitted into the opening 216 and so as to be retained on the right inner peripheral portions 291. In addition, the top, bottom, front and rear walls 21,25,26,28 respectively have right end edges 292 which are disposed transverse to the right inner peripheral portions 291. The right wall 24 further has an annular protrusion 242 which is disposed around the plug portion 241 and which is welded to the right end edges 292 so as to connect the right wall 24 integrally with the top, bottom, front and rear walls 21,25,26,28.

An insulating guide slope member 214 is mounted on the bottom wall 25, and has a guiding surface which includes right and left ends 2141,2142 respectively proximate to the right and left walls 24,26 and a middle portion 2143 interposed therebetween, and which is raised from the left end 2142 to the right end 2141.

As shown in FIG. 6, each first electric contact member 23' includes a first insert end portion 232' which is of such a dimension so as to be press fitted within the respective first insert hole 212 and which extends in the second transverse direction into the accommodating space 211 towards the right wall 24. The first insert end portions 232' of the first electric contact members 23' are disposed outboard to the guiding slope member 214, are parallel to each other, and are spaced apart from each other in the first transverse direction with the first distance so as to define a rolling guideway therebetween. Each first electric contact member 23' further includes a first electric contact terminal 233' which is disposed opposite to the first insert end portion 232' in the second transverse direction, which extends outwardly of the left wall 26 and which is bent downwardly to extend beyond the bottomwall 25 so as to be adapted to be mounted on a support, such as a circuit board 30.

Each second electric contact member 23 includes a second insert end portion 232 which is of such a dimension so as to be press fitted within the respective second insert hole 213 and which extends in the second transverse direction into the accommodating space 211 such that the second insert end portions 232 of the second electric contact members 23 are spaced apart from the first insert end portions 232' of the first electric contact members 23' with a second distance in the longitudinal direction and are shorter than the first insert end portions 232' in the second transverse direction. A second electric contact terminal 233 is disposed opposite to the second insert end portion 232 in the second transverse direction, extends outwardly of the left wall 26, and is bent downwardly to extend beyond the bottom wall 25 so as to be adapted to be mounted on the circuit board 30. Each of the first and second insert end portions 232',232 and the first and second electric contact terminals 233',233 has a tapered end 231',231 to facilitate the press fitting thereof in the respective one of the first and second insert holes 212,213 and the circuit board 30.

Figure 7:
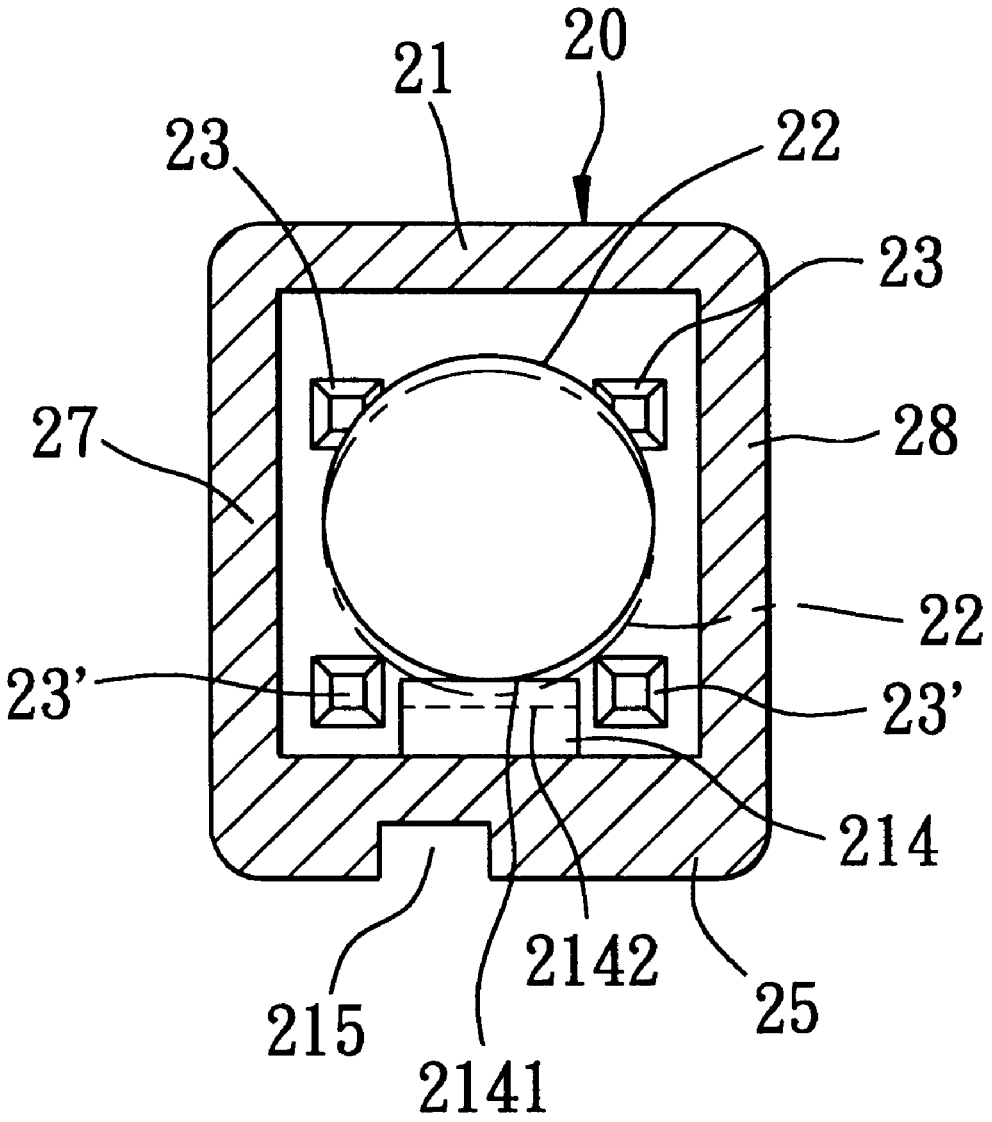
FIG. 7 is a cross-sectional view of the preferred embodiment.
Figure 8:
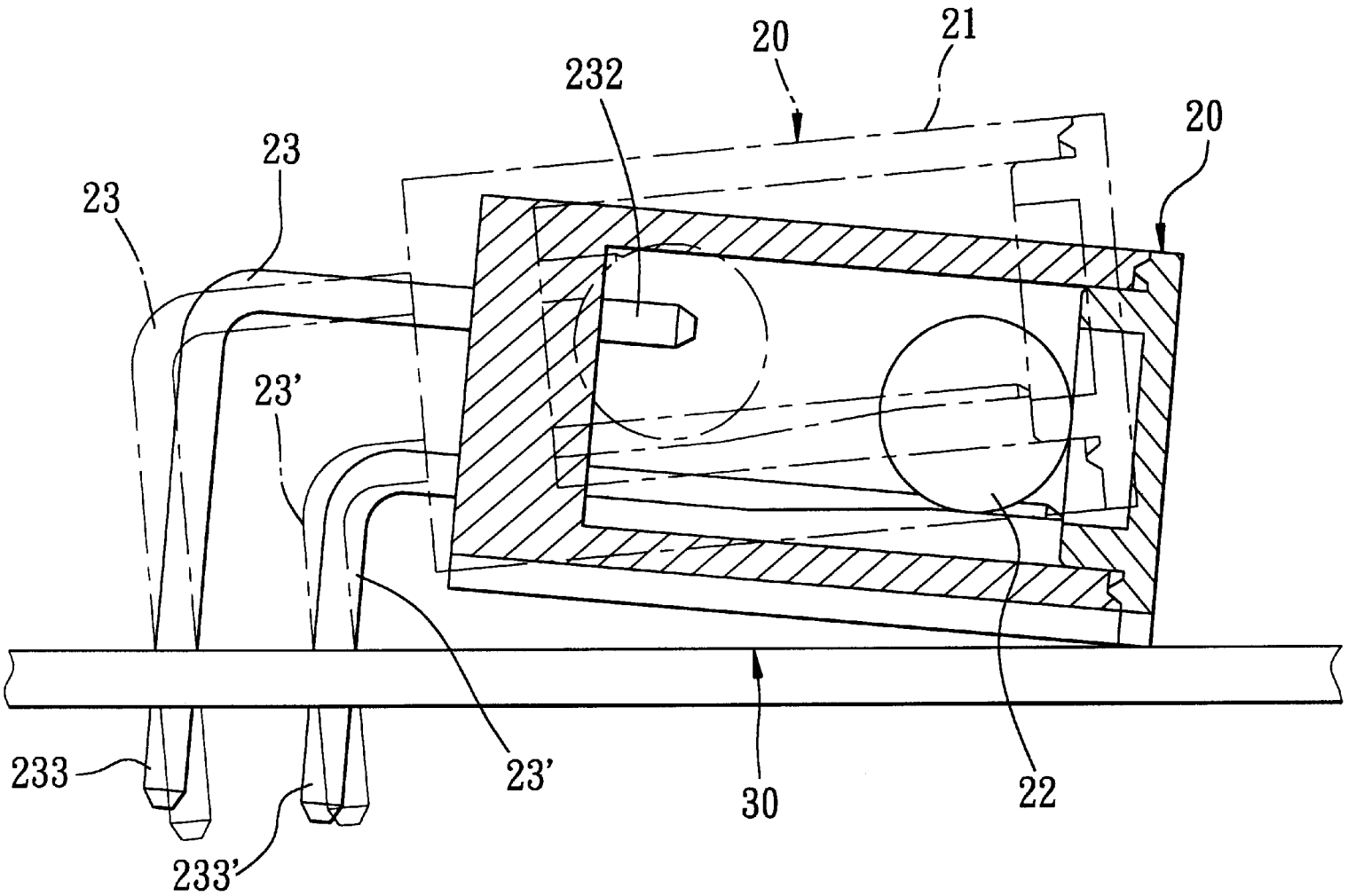
FIG. 8 is a sectional schematic view of the preferred embodiment in a tilted state.

The electrically conductive ball member 22 is disposed in the accommodating space 211, and has a diameter larger than both the first and second distances such that the ball member 22 is on the left end 2142 of the guiding slope member 214 to engage the first insert end portions 232' of the first electric contact members 23'. The ball member 22 is movable on and is guided by the rolling guideway and the guiding slope member 214 between a first position where the ball member 22 engages the second insert end portions 232 of the second electric contact members 23 when the rolling guideway is in a horizontal position so as to establish electrical connection among the first and second electric contact terminals 233',233 (as shown in FIG. 6 and the dotted lines in FIG. 7), and a second position where the ball member 22 is on the right end 2141 or the middle portion 2143 to disengage the second insert end portions 232 of the second electric contact members 23 when the rolling guideway is tilted from the horizontal position so as to break the electrical connection among the first and second electric contact terminals 233',233 (as shown by the solid lines in FIGS. 7 and 8).

Moreover, the bottom wall 25 and the right wall 24 further have guide grooves 215,243 which are registered with each other and which extend in the second transverse direction so as to be adapted to be slidably mounted on a rail member (not shown) of the circuit board 30 to enable easy adjustment of the rolling guideway in the horizontal position.

As mentioned above, the first and second electric contact members 23',23 are press fitted within the first and second insert holes 212,213 in the left wall 26 so as to be secured firmly on the insulating housing 20. In addition, due to the presence of two first electric contact members 23', the ball member 22 engages at least one of the first electric contact members 23' so as to ensure the electrical connection among the first and second electric contact terminals 233',233 when the ball member 22 is in the first position.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A tilt switch mountable on and in electric contact with a support in an upright position, said tilt switch comprising:

an insulating housing including top and bottom walls spaced apart from each other in a longitudinal direction when said tilt switch is in the upright position, front and rear walls spaced apart from each other in a first transverse direction transverse to the longitudinal direction and extending from said top wall to said bottom wall in the longitudinal direction, and right and left walls spaced apart from each other in a second transverse direction transverse to both the longitudinal and first transverse directions and extending from said top wall to said bottom wall in the longitudinal direction so as to cooperate with said front, rear, top and bottom walls to confine an accommodating space, said left wall having an inner wall surface and an outer wall surface disposed opposite to said inner wall surface in the second transverse direction and having two first insert holes which are disposed proximate to said bottom wall and at least one second insert hole which is disposed proximate to said top wall, each of said first and second insert holes extending in the second transverse direction to communicate with said inner wall surface, said first insert holes being aligned with and spaced apart from each other in the first transverse direction, and defining a first distance therebetween in the first transverse direction;

a pair of elongate first electric contact members, each including a first insert end portion of such a dimension so as to be press fitted within a respective one of said first insert holes and extending in the second transverse direction into said accommodating space towards said right wall, said first insert end portions of said first electric contact members being parallel to each other and being spaced apart from each other in the first transverse direction with said first distance so as to define a rolling guideway therebetween, each of said first electric contact members further including a first electric contact terminal disposed opposite to said first insert end portion in the second transverse direction and extending outwardly of said left wall and bent downwardly to extend beyond said bottom wall, said first electric contact terminals of said first electric contact members being mountable on the support;

at least one elongate second electric contact member including a second insert end portion of such a dimension so as to be press fitted within said at least one second insert hole and extending in the second transverse direction into said accommodating space such that said second insert end portion is spaced apart from said first insert end portions with a second distance in the longitudinal direction and is shorter than said first insert end portions in the second transverse direction, and a second electric contact terminal disposed opposite to said second insert end portion in the second transverse direction, extending outwardly of said left wall, and bent downwardly to extend beyond said bottom wall, said second electric contact terminals of said second electric contact members being mountable on the support; and an electrically conductive ball member disposed in said accommodating space, and having a diameter larger than both the first and second distances such that said ball member engages said first insert end portions and is movable on and is guided by said rolling guideway between a first position where said ball member engages said second insert end portion when said rolling guideway is in a horizontal position so as to establish electrical connection among said first and second electric contact terminals, and a second position where said ball member is proximate to said right wall to disengage said second insert end portion when said rolling guideway is tilted from the horizontal position so as to break the electrical connection among said first and second electric contact terminals.

2. The tilt switch as claimed in claim 1, wherein said top, bottom, front and rear walls respectively have right inner peripheral portions connected to one another to confine an opening, said right wall being provided with a plug portion of such a dimension so as to be press fitted into said opening and so as to be retained on said right inner peripheral portions.

3. The tilt switch as claimed in claim 2, wherein said top, bottom, front and rear walls respectively have right end edges disposed transverse to said right inner peripheral portions, said right wall further having an annular protrusion disposed around said plug portion and welded to said right end edges so as to connect said right wall integrally with said top, bottom, front and rear walls.

4. The tilt switch as claimed in claim 1, further comprising an insulating guide slope member mounted on said bottom wall between said first insert end portions, and having a guiding surface which has right and left ends respectively proximate to said right and left walls and which is raised from said left end to said right end for guiding the movement of said ball member between the first and second positions.

5. The tilt switch as claimed in claim 1, wherein said bottom wall has a guide groove extending in the second transverse direction and slidably mounted on a rail member of the support so as to enable adjustment of said rolling guideway in the horizontal position.

6. The tilt switch as claimed in claim 1, wherein each of said first and second insert end portions has a tapered end to facilitate the press fitting thereof in the respective one of said first and second insert holes.

* * * * *